US005979689A

United States Patent [19]

Lansky

[11] Patent Number: 5,979,689

[45] Date of Patent: Nov. 9, 1999

[54] SPLASH/SLOSH GUARD FOR DRINKING VESSELS

[76] Inventor: Daryl J. Lansky, 548 Valleybrook Dr., Memphis, Tenn. 38120

[21] Appl. No.: 08/679,455

[22] Filed: Jul. 9, 1996

Related U.S. Application Data

[63] Continuation-in-part of application No. 08/389,765, Feb. 16, 1995, Pat. No. 5,540,350.

[51] Int. Cl.[6] ..... B65D 43/03; A47G 19/22

[52] U.S. Cl. ..... 220/255; 220/713; 220/277; 222/547

[58] Field of Search ..... 220/380, 713, 220/703, 704, 711, 719, 731, 734, 373, 374, 253, 254, 256, 255, 263, 277, 278; 222/547, 564, 541.6, 541.8, 525, 559, 563

[56] References Cited

U.S. PATENT DOCUMENTS

| | | | |
|---|---|---|---|
| 1,739,627 | 12/1929 | Austin . | |
| 1,811,896 | 6/1931 | Ross . | |
| 2,362,354 | 11/1944 | Clovis . | |
| 2,600,479 | 6/1952 | Campomar . | |
| 2,762,532 | 9/1956 | Packwood, Jr. . | |
| 2,858,041 | 10/1958 | Robinson . | |
| 3,302,833 | 2/1967 | Leika . | |
| 3,321,114 | 5/1967 | Croyle | 222/525 |
| 3,360,161 | 12/1967 | Smith . | |
| 3,549,044 | 12/1970 | Lerner . | |
| 3,727,808 | 4/1973 | Fitzgerald | 220/715 X |
| 3,730,399 | 5/1973 | Dibrell et al. | 220/715 X |
| 4,130,215 | 12/1978 | Corey et al. . | |
| 4,171,060 | 10/1979 | Howard et al. | 220/715 X |
| 4,190,173 | 2/1980 | Mason et al. | 220/715 X |
| 4,712,704 | 12/1987 | Ramsey et al. | 220/715 X |
| 4,768,674 | 9/1988 | Prescott . | |
| 5,294,014 | 3/1994 | Wyatt et al. | 220/715 X |
| 5,601,203 | 2/1997 | Brun, Jr. | 220/253 |
| 5,702,025 | 12/1997 | Di Gregorio | 220/714 X |

FOREIGN PATENT DOCUMENTS

| | | | |
|---|---|---|---|
| 78710 | 6/1962 | France | 220/253 |

*Primary Examiner*—Stephen K. Cronin
*Assistant Examiner*—Nathan Newhouse
*Attorney, Agent, or Firm*—Garrison, Morris & Haight, PLLC

[57] ABSTRACT

A guard for preventing spilling or splashing of hot or cold liquids from a drinking container when the container is moved or when drinking therefrom. The guard includes a lower lid attached to the drinking container and an upper lid attachable to the lower lid which is selectively movable between an open position and a closed position. The lower lid includes a resilient sidewall for sealably engaging the inner surface of the drinking container to prevent the beverage from flowing therebetween when the container is moved or when drinking therefrom. A plurality of openings evenly spaced around the center of the lower lid are also provided in the lower lid for allowing the beverage to pass from beneath the lower lid to a position thereabove when the upper lid is in the open position. In order to make the drinking container substantially spillproof, the upper lid includes a plurality of downwardly extending members extending partially into and sealably engaging the openings in the lower lid when the upper lid is in the closed position which substantially prevents the flow of beverage from beneath the lower lid to the position above the lower lid. Each of the downwardly extending members includes a pair of radially extending sidewalls for baffling the beverage when the upper lid is pulled apart from the lower lid and rotated into the open position thereby allowing the drinking container to be substantially splashproof when the drinking container is in motion or when drinking therefrom. The upper edge of the sidewall of the lower lid may include an annular rim for engaging the rim of the drinking container which axially positions the lower lid within the drinking container.

21 Claims, 10 Drawing Sheets

SPLASH/SLOSH GUARD FOR DRINKING VESSELS

This application is a continuation-in-part of application Ser. No. 08/389,765 filed on Feb. 16, 1995 now U.S. Pat. No. 5,540,350.

TECHNICAL FIELD

The present invention relates generally to an apparatus for preventing splashing, sloshing or spilling of hot or cold liquids from a drinking container such as a disposable cup, beverage can, mug or similar vessel, and more specifically, to a guard for use in combination with a drinking container containing a hot or cold beverage which allows the container to be moved from one location to another without sloshing or spilling the beverage from the container particularly when drinking from the container while driving or engaging in other activities.

BACKGROUND

Often it is desirable to move a container of hot or cold beverage from one location to another without sloshing or spilling the contents of the container, particularly when drinking from the container while driving or engaging in other activities. However, transporting a drinking container of hot liquid represents a substantial safety hazard especially if being carried in a moving vehicle. Any sudden movement of the container can cause surging and spillage of the hot liquid resulting in serious burns and damage to personal property.

A variety of splash resistant devices have been developed in response to the above and similar problems for use with drinking containers. Some of these devices substantially enclose the liquid within the container and typically include an opening along its outer periphery at the rim of the container for allowing direct access to the liquid. A major problem with this type of device, however, is that the liquid will surge or splash through the opening if the container is abruptly moved which may result in serious burns if the liquid is hot. Also, the user must inspect the container in order to align the opening with their mouth before each instance of drinking which may be particularly dangerous if the user is operating a moving vehicle. Substantially enclosing the liquid within the container also prevents a release of the liquid's fragrance from the container therefore inhibiting the user's sense of smell and taste.

It is therefore desirable to have a guard that is easily adapted to a wide variety of drinking containers such as plastic cups, beverage cans, mugs or similar vessels without having to modify the container and which substantially prevents splashing, sloshing, surging or spillage of the beverage from the container if the container is moved. It is further desirable to have such a guard that will enable the drinking of the beverage from the container without splashing, sloshing, surging or spillage of the beverage from the container and without having to align the container with a user's mouth before each instance of drinking.

SUMMARY

In view of the foregoing disadvantages in the known types of splash resistant devices, the present invention addresses the above problems by providing an improved splash guard which prevents splashing, sloshing, surging or spillage of hot or cold liquids from a drinking container such as a disposable cup, beverage can, mug or similar vessel. As such, the principal object of the present invention is to provide an improved splash guard that is easily adapted to a wide variety of drinking containers which is so constructed that the contents therein will not splash, surge or spill out of the container when the container is moved or when a person is drinking therefrom.

In support of the principal object, a further object of the present invention is to provide a means for making a drinking container splashproof wherein such means does not have to be removed or adjusted when one wishes to drink from the container.

It is a further object of the present invention to provide an improved splash guard which may be used by children and others who are unsteady in their hand movements and which will permit such persons to drink from a container without spilling the contents of the container.

A still further object of the present invention is to provide an improved splash guard which may be easily cleaned and sanitized so as to prevent the transfer of harmful germs from one user to the next.

It is yet another object of the present invention to provide an improved splash guard which may be used with existing drinking containers so as to make them splashproof without altering the present construction of the container.

Still another object of the present invention is to provide a means for drinking from any location around the rim of a container without sloshing or spilling the contents.

It is still further an object of the present invention to provide an improved splash guard for use with a drinking container which dispenses with the necessity of having to align the container with the drinkers' mouth before each instance of drinking. This feature allows for normal retreat of the beverage, thus further prevents splashing or spilling while drinking in motion, unlike known splash resistant devices having openings that must be aligned for fluid transfer.

A further object of the present invention is to provide an improved splash guard for a drinking container which allows one to drink from the container without rotating the container to a drinkable position.

Another object of the present invention is to prevent spillage and sloshing of a beverage from a drinking container to a higher degree than heretofore possibly by the use of vertical baffles as well as a lower level disk or baffle having a continuous outer rim means for engaging the inner surface of the drinking container, and without compromising access to drinking from the container.

A still further object of the present invention is to provide an improved splash guard that may be secured in place by friction without any modification of the drinking container and that is easily removed. The improved splash guard may be secured within the container or at the rim of the container.

It is yet another object of the present invention to allow for easily replenishment of beverage into the drinking container without removing the improved splash guard.

Another object of the present invention is to allow the drinking container to be sufficiently vented when the improved splash guard is in an open position which enables heat to escape other than at the primary location from which a person must drink, thus further enabling a person to experience a sense of smell as well as taste.

Still yet another object of the present invention is to provide an improved splash guard which may engage the interior surface of the drinking container or its rim.

A further object of the present invention is to provide an improved splash guard which includes a removable rim that is easily separated along perforations or a scored line which is attached to an outer circular rim of the upper disk for sealably engaging the rim or upper edge of the drinking container when the guard is in a first condition for use with the drinking container to transport liquids that are not ready to be consumed. The removable rim is detachable from the outer circular rim of the upper disk to provide a second condition of the guard in which the guard is used for preventing splashing or sloshing of a beverage from the drinking container with which the guard is used.

It is yet another object of the present invention to provide an improved splash guard that has the ability to be opened and closed by a user. In the closed position, the splash guard prevents spilling of liquid from the drinking container which enables the transportation of liquid that is not ready to be consumed. In the open position, the splash guard prevents splashing or sloshing of a liquid from the drinking container when the container is in motion The splash guard may be a two piece assembly consisting of an upper lid and lower lid. The upper lid may be pulled apart from the lower lid, which is attached to the drinking container, enabling the user to refill the container with the same or different beverages or to add ingredients to the beverage. When the upper lid is pulled apart from the lower lid, the lower lid still provides a reduced degree of slosh resistance. Attachment of the lower lid to the drinking container may be accomplished by various methods universally accepted in the industry including snap or screw-on lids.

Still another object of the present invention is to provide an improved splash guard which is sturdy in construction, light in weight, economical in price, relatively simple to manufacture, and reusable or disposable.

These together with other objects of the present invention, along with the various features of novelty which characterize the invention, are accomplished through the use of an improved splash guard which prevents spilling or splashing of a beverage from a drinking container having sidewall with inner and outer surfaces and a rim. The splash guard includes a lower lid which is attached to the drinking container and an upper lid attachable to the lower lid which can be selectively moved between an open position and a closed position. The lower lid includes a sealing means preferably in the form of a resilient sidewall for sealably engaging the inner source of the drinking container to prevent the beverage from flowing therebetween when the container is moved or when drinking herefrom. A passageway means comprised of a plurality of openings evenly spaced around the center of the lower lid is also provided in the lower lid for allowing the beverage to pas from beneath the lower lid to a position thereabove when the upper lid is in the open position. In order to make the drinking container substantially spillproof, the upper lid includes a means for sealably engaging the plurality of openings when the upper lid is in the closed position which substantially prevents the flow of beverage from beneath the lower lid to the position above the lower lid. The means for sealably engaging the plurality of openings also includes a baffle means for baffling the beverage when the upper lid is in the open position thereby allowing the drinking container to be substantially splashproof when the drinking container is in motion or when drinking therefrom. The upper edge of the sidewall of the lower lid may include an annular rim for engaging the rim of the drinking container which sealably engages the rim of the drinking container and axially positions the lower lid within the drinking container. The splash guard may further include a means for selectively locking the upper lid in the open or closed positions and a means for rotationally aligning the upper lid in the open position.

There has thus been outlined, rather broadly, the more important features of the present invention in order that the detailed description thereof that follows may be better understood, and that the present contribution to the art may be better appreciated. There are, of course, numerous other novel features of the present invention that will become apparent from a study of the drawings and the description of the preferred embodiments and which will form the subject matter of the claims appended hereto.

Moreover, it is to be understood that the phraseology and terminology employed herein are from the purpose of description and should not be regarded as limiting. As such, those skilled in the art will appreciate that the conception, upon which this disclosure is based, may readily be utilized as a basis for the designing of other devices for carrying out the several purposes of the present invention. It is important, therefore, that the claims be regarded as including such equivalent systems insofar as they do not depart from the spirit and scope of the present invention.

DESCRIPTION

Figure 1:
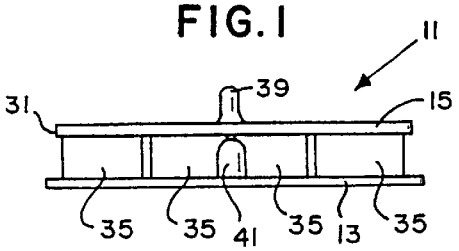
FIG. 1 is a side elevational view of a representative splash guard embodying the features of the present invention.
Figure 2:
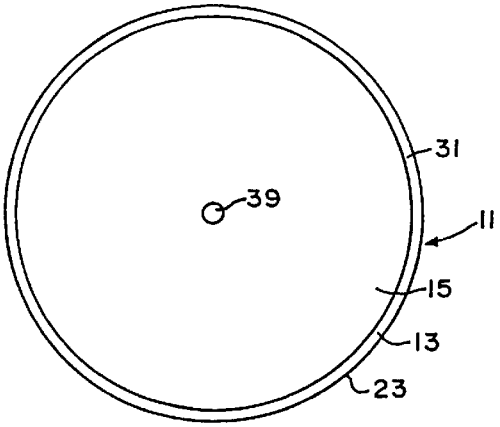
FIG. 2 is a top plan view of the splash guard shown in FIG. 1.

Referring now in more detail to the drawings, FIGS. 1–5 disclose a preferred embodiment of the present invention which includes a representative splash guard 11 that is easily adapted for use with a wise variety of drinking containers, such as a disposable plastic drinking cup 19, which prevents splashing, sloshing, surging or spillage of hot or cold liquids, such as liquid B, from the container when it is moved or when a person is drinking therefrom. Guard 11 is generally comprised of a lower baffle or disk 13, an upper baffle or disk 15 and a baffle means 17 interposed between lower disk 13 and upper disk 15. It should be noted that disks 13 and 15 also function as baffles, but for clarity will be hereinafter referred to as "disks".

Figure 5:
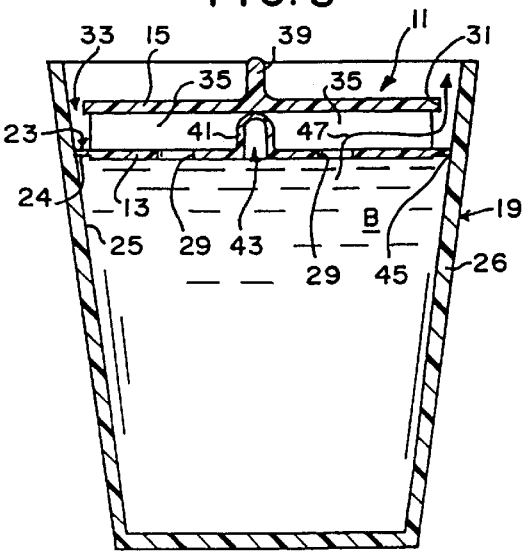
FIG. 5 is a side elevational view of the splash guard and plastic drinking cup taken along line 5—5 of FIG. 4.

As best illustrated in FIG. 5, lower disk 13 includes a continuous outer circular rim 23 for operatively engaging an inner surface 25 of side wall 26 of cup 19. A gasket or flap 24 extends around rim 23 in order to assist in seating and sealing lower disk 13 onto inner surface 25. Flap 24 is preferably constructed of the same material as guard 11 and is preferably, though not necessarily, thinner and more flexible. As such, flap 24 allows guard 11 to be easily adapted to drinking containers having different sizes and shapes. It should be noted, however, that flap 24 may be omitted without departing from the spirit and scope of the present invention in which case outer rim 23 engages the inner surface 25 of cup 19 as described above.

Figure 3:
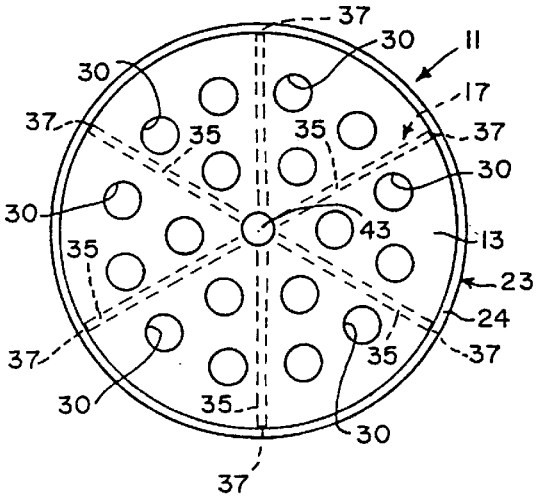
FIG. 3 is a bottom plan view of the splash guard shown in FIG. 1.
Figure 4:
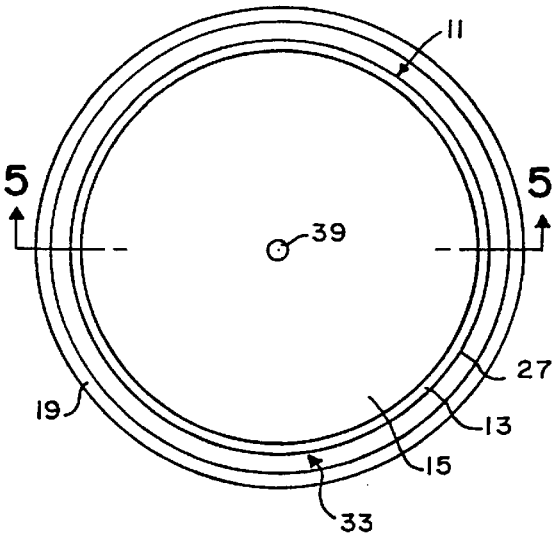
FIG. 4 is a top plan view of the splash guard shown mounted in a plastic drinking cup.

Referring to FIGS. 3 and 5, lower disk 13 further includes a passageway means 29 for allowing beverage B to pass from beneath lower disk 13 to a position above lower disk 13 between disks 13 and 15. Passageway means 29 is comprised of one or more openings 30 through lower disk 13 which may be any shape including circular, rectangular, triangular or heart shaped. As discussed below in greater detail, openings 30 are preferably spaced in a uniform manner around the center lower disk 13 so as to provide and equal number of openings 30 between baffles 35 which assures uniform fluid transfer through lower disk 13 regardless of the angle at which cup 19 is tilted. In a preferred embodiment, lower disk 13 includes three circular openings 30 arranged in a triangular pattern between each adjacent pairs of baffles 35.

Upper disk 15 includes a continuous outer circular rim 31 which is slightly smaller in diameter than outer rim 23 and is held in spaced apart relationship above lower disk 13 preferably on the same vertical axis by baffle means 17. As such, the diameter of outer rim 31 is slightly smaller than the diameter of the inner surface 25 of side wall 26 defining an annular passage 33 which allows beverage B to flow between the outer rim 31 of the upper disk 15 and the inner surface 25 of cup 19 at any point around outer rim 31 regardless of the orientation of cup 19. Therefore, cup 19 does not have to be oriented in any particular fashion so that openings are aligned with the user's mouth before each instance of drinking as is typically required with known splash resistant devices.

Baffle means 17 is comprised of a plurality of vertically disposed flat sheet-like baffles 35 extending radially outwardly from the center of guard 11 between disks 13 and 15 where they terminate at ends 37 adjacent to outer rim 31. As illustrated in FIG. 3, guard 11 preferably includes six baffles 35 spaced at sixty-degree intervals, however, the number and spacing of baffles 35 may vary in accordance with cost and construction complexity.

An upwardly extending tab or handle 39 may be fixedly attached to the center of upper disk 15 to provide a means for easily grasping guard 11. A corresponding upwardly extending receptacle 41 may be fixedly attached to the center of lower disk 13. Receptacle 41 is provided with a downwardly opening socket 43 which extends through lower disk 13 and is sized to loosely receive a handle 39. Thus, a plurality of guards 11 may be stacked one upon another with the handles 39 of adjacent lower guard 11 respectively extending into sockets 43 of adjacent upper guards 11.

Operation of the present invention may be accomplished simply by grasping handle 39 and axially pressing guard 11 downwardly, lower disk 13 first, into cup 19 until flap 24 of outer rim 23 frictionally and sealably engages the inner surface 25 of side wall 26 preferably in a horizontally disposed position adjacent the normal filling level 45 of cup 19. The flexibility of flap 24 facilitates insertion of a single size guard 11 into cups having a size range as may be typically found in commercial establishments. Moreover, the resilient nature of flap 24 also facilitates insertion of guard 11 within containers having various internal configurations by radially conforming to the interior wall of such containers.

Insertion of guard 11 does not have to occur after the cup 19 has been filled with beverage B. It should be understood that guard 11 can be placed in cup 19 either before or after it is filled. Following insertion of guard 11 and filling of cup 19 with beverage B, normal usage of the present invention may ensue, with the disks 13 and 15 and baffles 35 functioning to severely limit splashing, sloshing, surging or spilling of beverage B from cup 19 when it is moved or when drinking therefrom.

As mentioned above, the baffling of liquid B may be attributable to several features of the present invention. It is believed that the surging movement of beverage B against and upwardly along the inner surface 25 of side wall 26 when cup 19 is moved causes the sloshing and splashing of beverage B. The sealing engagement of outer rim 23 and/or flap 24 with the inner surface 25 of side wall 26 prevents beverage B from surging upwardly along inner surface 25 over rim of cup 19. If the cup 19 is held in an upright position and given a sudden movement, some of beverage B may travel upwardly through the openings 30 in lower disk 13. However, further motion of beverage B is inhibited by upper disk 15 and baffles 35. The portion of beverage B that has traveled through openings 30 will not exit cup 19 but will contact upper disk 15. Upper disk 15 functions to at least partially absorb the kinetic energy of beverage B allowing some of the beverage to rebound off of upper disk 15 downwardly back through openings 30 into cup 19. The remainder of beverage B above lower disk 13 still processing kinetic energy will be channeled radially outwardly along baffles 35, thereby redirecting the otherwise axial movement of beverage B. The surface area of baffles 35 provides sufficient frictional resistance to absorb the remaining kinetic energy allowing the remainder of beverage B to flow back through openings 30 into cup 19.

The movement of beverage B when drinking from cup 19 is similar to that described above. It should be understood, however, that a user can drink from any location around the rim of cup 19 as opposed to having to align an opening with the user's mouth before each instance of drinking. This advantage is particularly apparent when the user desires to drink a beverage such as hot coffee while driving a vehicle and, at that user's risk and at the risk of other passengers, must divert his or her attention from driving to align the opening with their mouth in order to drink the coffee. In direct contrast, the present invention allows the user to drink from cup 19 as if there was no guard 11 present. Cup 19 is brought to the mouth and tilted in normal fashion. Beverage B flows through openings 30 of lower disk 13 and is directed radially outwardly by baffles 35 whereupon it is allowed to flow between outer rim 31 of upper disk 15 and the inner surface 25 of side wall 26 at any point around outer rim 31. Once beverage B flows between outer rim 31 and inner surface 25, it travels upwardly along inner surface 25 to the rim of cup where it meets the user's mouth. Referring to FIG. 5, arrow 47 indicated the flow of beverage B when the rim of cup 19 is tilted clockwise downwardly to the right.

Guard 11 may be integrally formed together as a single unit from plastic or the like. It is further conceivable that materials other than plastics could also be utilized for construction of the present invention. Fiber materials, paper products, biodegradable or otherwise, could be used where disposable usage is desired or where it may be desired to impregnate porous materials with additives intended to interact with the liquid in the container. The only requirement is that the material be capable of use with a variety of hot or cold liquids for human consumption. Further, guard 11 may be transparent, translucent, opaque or have any desired coloration for aesthetic purposes.

The accumulative effect of the above features and quite possibly others that are inherent in the present invention cooperate to produce and extremely effective baffling function against fluid motion resulting from external shock or sudden motion of the container. As stated earlier, this advantageous baffling effect has no determinable detrimental effects on normal usage of the container. Drinking or pouring from the container can be accomplished in the normal manner, by tipping the container until the liquid spills over the containers' rim and will continue until the container is empty. Once the present invention has been utilized and the liquid is expended from the container, guard 11 may be easily removed from the container and cleaned. Alternatively, a guard 11 that is constructed for usage and disposal can be simply disposed of along with the container.

Figure 6:
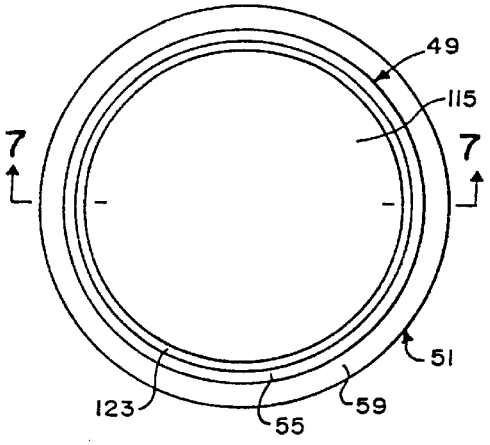
FIG. 6 is a top plan view of a first alternative embodiment of a representative splash guard shown mounted in a plastic drinking cup embodying the features of the present invention.
Figure 7:
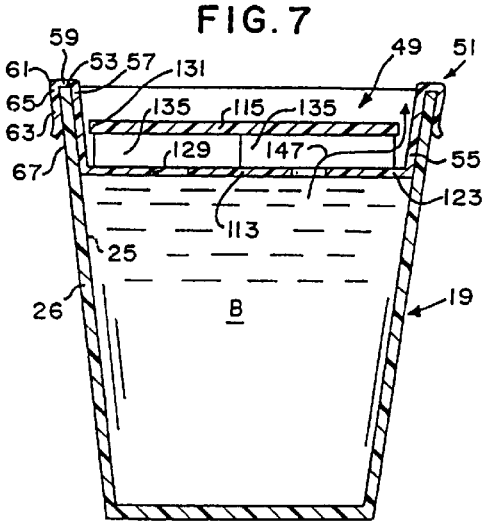
FIG. 7 is a side sectional view of the splash guard and plastic drinking cup taken along line 7—7 of FIG. 6.

A first alternative embodiment of the present invention is illustrated in FIGS. 6 and 7 which includes a modified guard 49. The parts of guard 49 which are the same as corresponding parts of guard 11 are designed by the same number as used for guard 11 preceded by the numeral 1. For instance, lower disk 113, upper disk 115, rim 123, rim 131 and baffles 135 of guard 49 correspond to and are the same construction as lower disk 13, upper disk 15, rim 23, rim 31 and baffles 35 of guard 11. The primary difference between guard 49 and guard 11 is a sealing lip or sealing means 51 attached to outer circular rim 123 of lower disk 113 for sealably engaging the inner surface 25 of sidewall 26 and upper edge 53 of cup 19. Sealing means 51 includes a frusto-conically shaped side wall 55 for engaging the inner surface 25 of side wall 26 of cup 19. An annular portion 59 is attached to an upper edge 57 of side wall 55 and extends radially outwardly therefrom terminating in a circular outer edge 61. In order to frictionally engage an outer surface 67 of side wall 26, sealing means 51 further includes a depending portion 63 having an upper edge 65 that is attached to outer edge 61 of annular portion 59. Guard 49 preferably has no flap 24, no handle 39, no receptacle 41 and no socket 43 although any or all of these parts may be included if desired. Operationally, guard 49 is used for preventing splashing and sloshing of beverage B in the same manner as heretofore described for guard 11. Arrow 147 indicates the flow of beverage B when the upper edge 53 of cup 19 is tilted clockwise downwardly to the right as viewed in FIG. 7.

Figure 8:
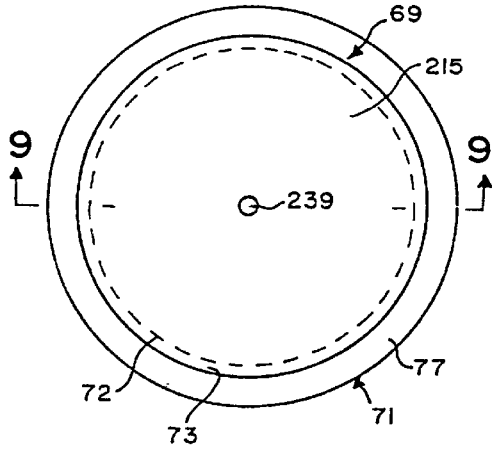
FIG. 8 is a top plan view of a second alternative embodiment of a representative splash guard shown mounted in a plastic drinking cup embodying the features of the present invention.
Figure 9:
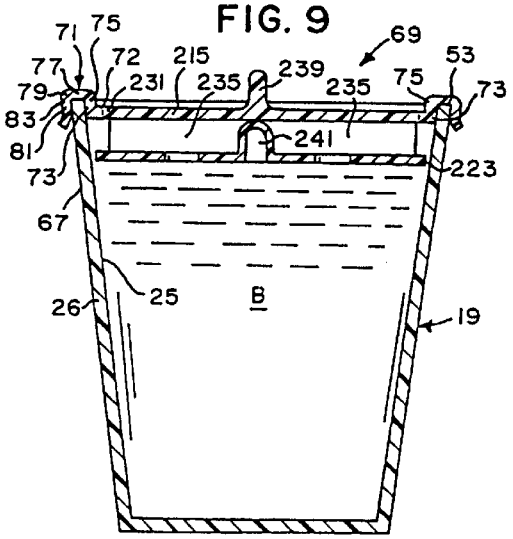
FIG. 9 is a side sectional view of the splash guard and plastic drinking cup taken along line 9—9 of FIG. 8.

A second alternative embodiment of the present invention is illustrated in FIGS. 8 and 9 which includes a modified guard 69. Similarly, the parts of guard 69 which are the same as corresponding parts of guard 11 are designed by the same number as used for guard 11 preceded by the numeral 2. Likewise, the primary difference between guard 69 and guard 11 is a removable rim or removable rim means 71 attached to the outer circular rim 231 of upper disk 215 for sealably engaging the rim or upper edge 53 of cup 19. Removable rim means 71 includes a frusto-conically shaped side wall 73 for engaging the inner surface 25 of side wall 26 of cup 19. A circular transverse portion 77 is attached to an upper edge 75 of side wall 73 and extends radially outwardly therefrom terminating in a circular outer edge 79. In order to frictionally engage the outer surface 67 of side wall 26, rim means 71 further includes a depending portion 81 having an upper edge 83 that is attached to outer edge 79 of annular portion 77.

Removable rim means 71 is easily detachable from outer circular rim 231 of upper disk 215 along a scored line or perforations 72. However, prior to detaching rim means 71 from upper disk 215, guard 69 cooperates with cup 19 to provide a spillproof container. A spillproof container may be desirable to a user since he or she may not be ready to immediately consume the beverage but would rather transport the beverage in a spillproof container. Furthermore, rim means 71 provides additional insulation to cup 19 thereby allowing cup 19 to retain the heat of the beverage for a longer period of time. Once rim means 71 is removed, guard 69 is transformed into a guard 11 and is used in the same manner as heretofore described for guard 11.

A third alternative embodiment of the present invention is illustrated in FIGS. 10–18 as having a modified guard 301. Guard 301 is generally comprised of a lower lid 302, shown in FIGS. 10–11, and an upper lid 303, shown in FIGS.

Figure 11:
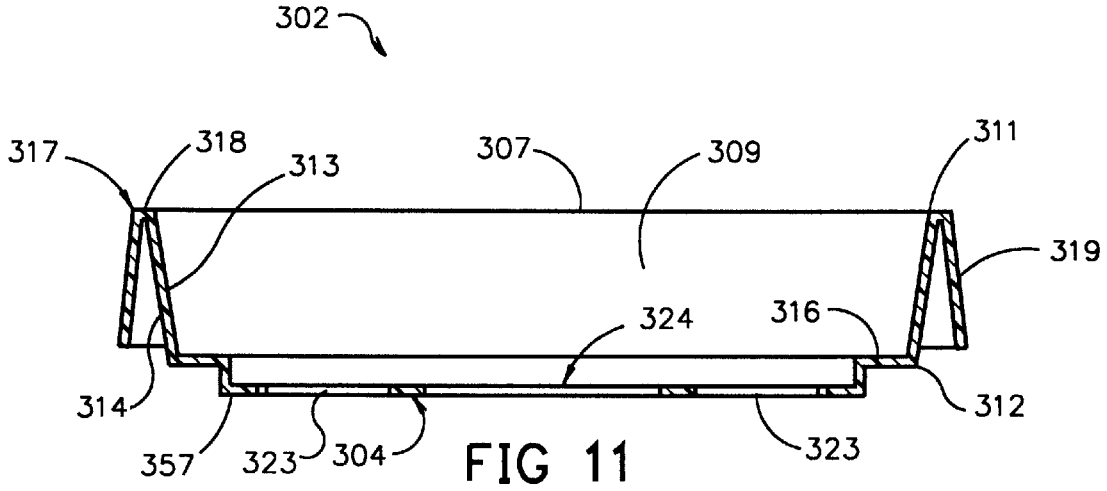
FIG. 11 is a side sectional view of the lower lid taken along line 11—11 of FIG. 10.

12–14. Lower lid 302 is attachable to cup 19 by any suitable means such as by friction or snapping or screwing onto cup 19. Lower lid 302 includes a generally circular disk 304 having a continuous outer rim 306 and a sealing means 307 for sealably engaging an inner surface 308 of cup 19. The sealing engagement between means 307 and inner surface 308 prevents beverage B from flowing therebetween when cup 19 is moved or when drinking therefrom. Sealing means 307 is comprised of an upwardly extending sidewall 309 having upper 311 and lower 312 edges and inner 313 and outer 314 surfaces. Sidewall 309 is preferably frusto-conically shaped, but may be generally cylindrical if desired. Outer surface 314 sealably engages the inner surface 308 of cup 19 when lower lid 302 is attached to cup 19. As best shown in FIG. 11, circular disk 304 includes and annular shoulder 316 which is integrally attached to the lower edge 312 of sidewall 309.

Lower lid 302 further includes an axial positioning means 317 for axially positioning the lower lid 302 within cup 19 preferably adjacent the normal filling level. Means 317 is comprised of an annular ledge 318 attached to the upper edge 311 of sidewall 309. Annular ledge 318 extends outwardly from sidewall 309 and engages the rim of cup 19 when the lower lid 302 is attached to cup 19 which determines the axial position of lower lid 302 within cup 19. Means 317 further comprises a depending portion 319 attached to annular ledge 318 which extends downwardly from ledge 318 around the rim of cup 19. Depending portion 319 may sealably engage an upper portion of the outer surface 321 of cup 19.

Figure 10:
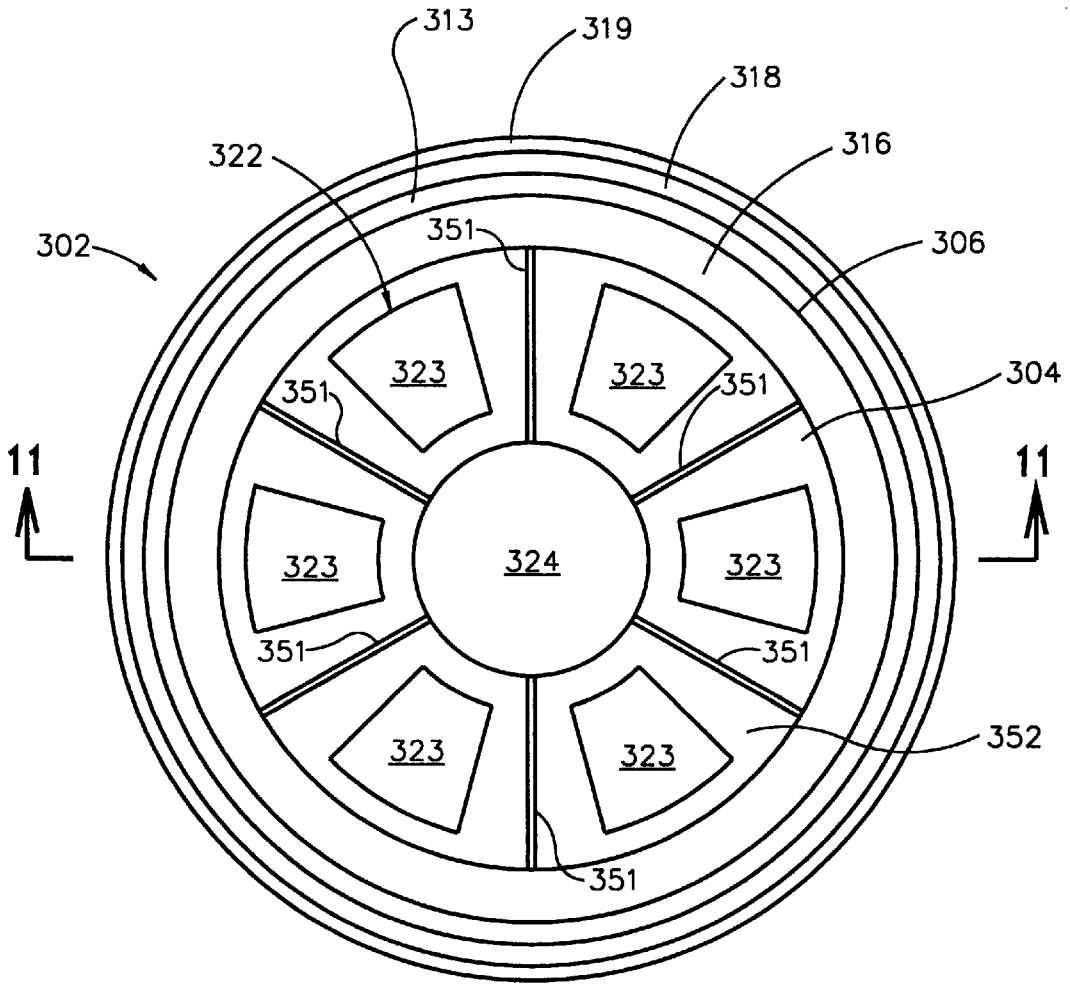
FIG. 10 is a top plan view of a lower lid of a third alternative embodiment of a representative guard embodying the features of the present invention.

Referring to FIG. 10, disk 304 further includes a generally circular central opening 324 and a passageway means 322 for allowing beverage B to pass from beneath disk 304 to a position above disk 304. Passageway means 322 is comprised of a plurality of openings 323 extending through disk 304 which may be any shape including circular, rectangular, triangular, or pie-shaped. Openings 323 are preferably spaced in a uniform even manner around the central opening 324 of disk 304 at sixty-degree intervals, however, the number, shape and spacing may vary in accordance with cost and construction complexity.

Figure 12:
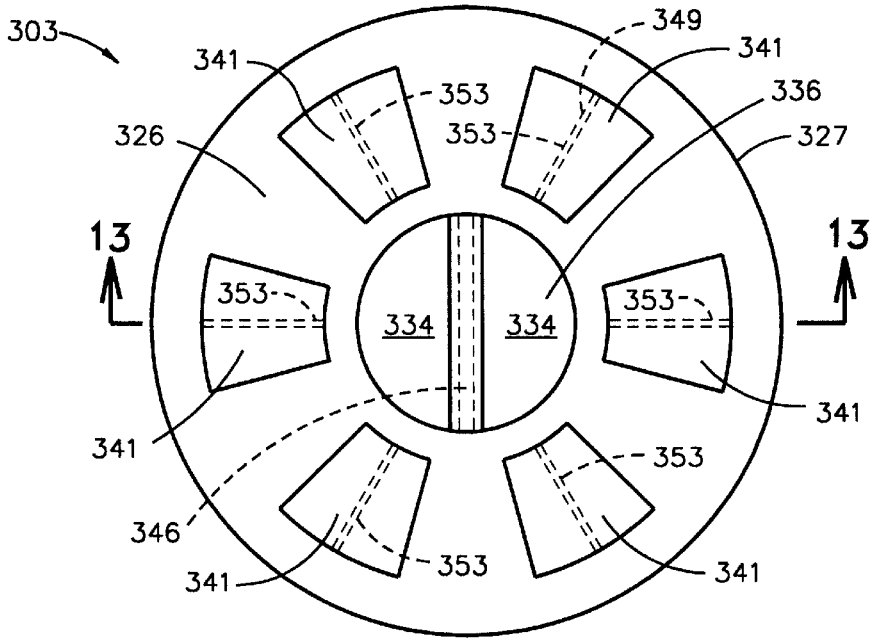
FIG. 12 is a top plan view of an upper lid of the third alternative embodiment of the guard embodying the features of the present invention.
Figure 13:
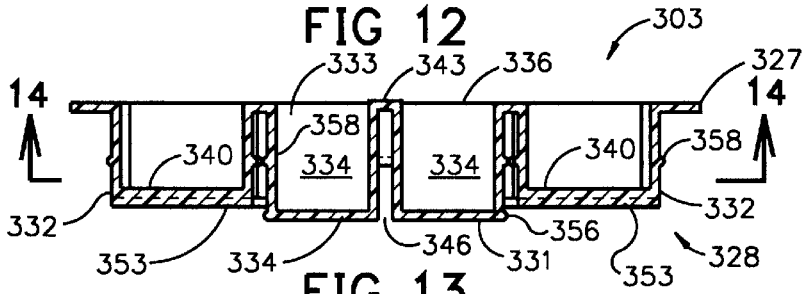
FIG. 13 is a side sectional view of the upper lid taken along line 13—13 of FIG. 12.
Figure 14:
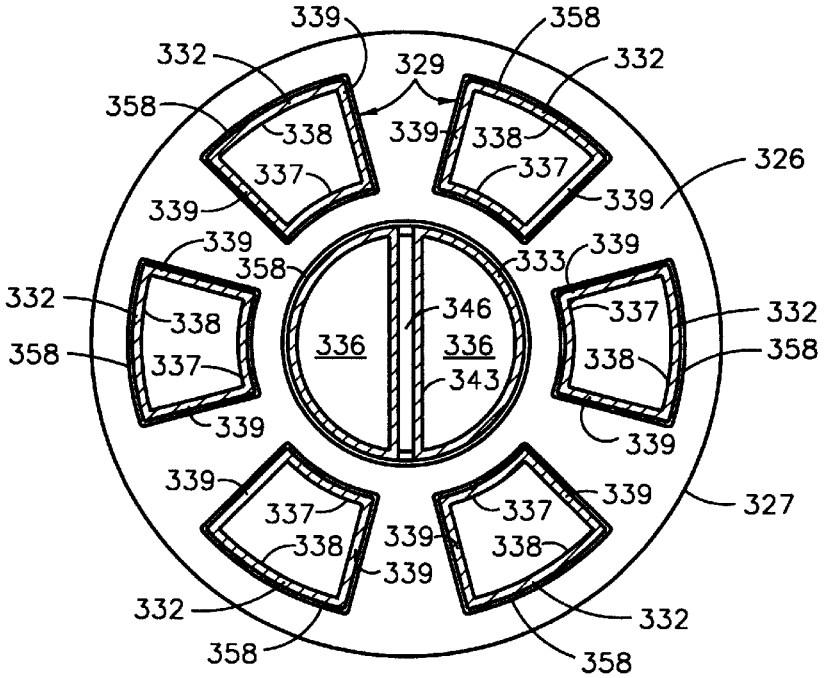
FIG. 14 is a bottom sectional view of the upper lid taken along line 14—14 of FIG. 13.
Figure 15:
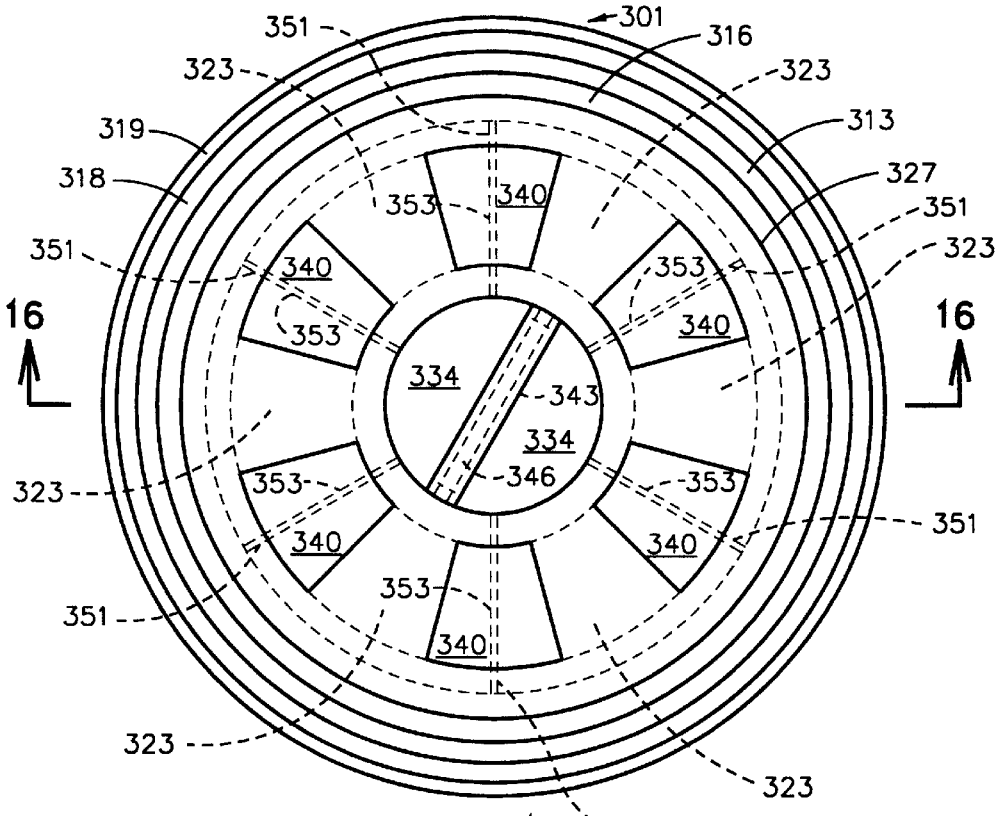
FIG. 15 is a top plan view of the upper and lower lids of the third alternative embodiment of the guard shown attached to a plastic drinking cup and in an open position embodying the features of the present invention.
Figure 16:
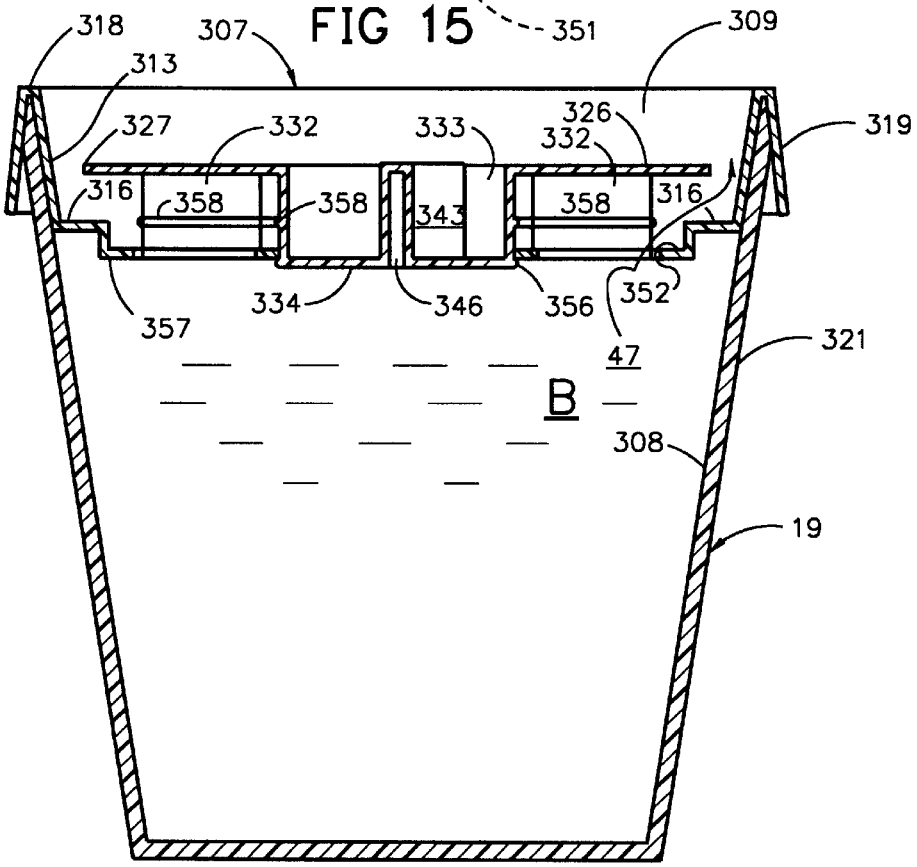
FIG. 16 is a side sectional view of the upper and lower lids and the plastic drinking cup taken along line 16—16 of FIG. 15.
Figure 17:
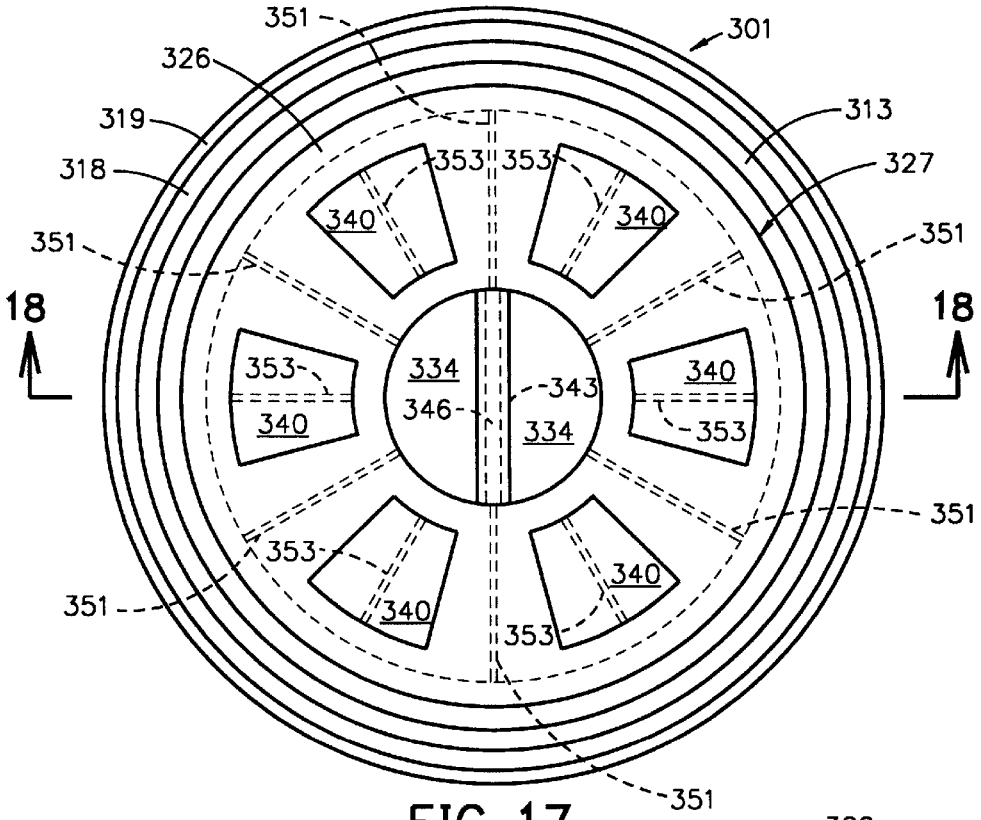
FIG. 17 is a top plan view of the upper and lower lids of the third alternative embodiment of the guard shown attached to a plastic drinking cup and in a closed position embodying the features of the present invention.
Figure 18:
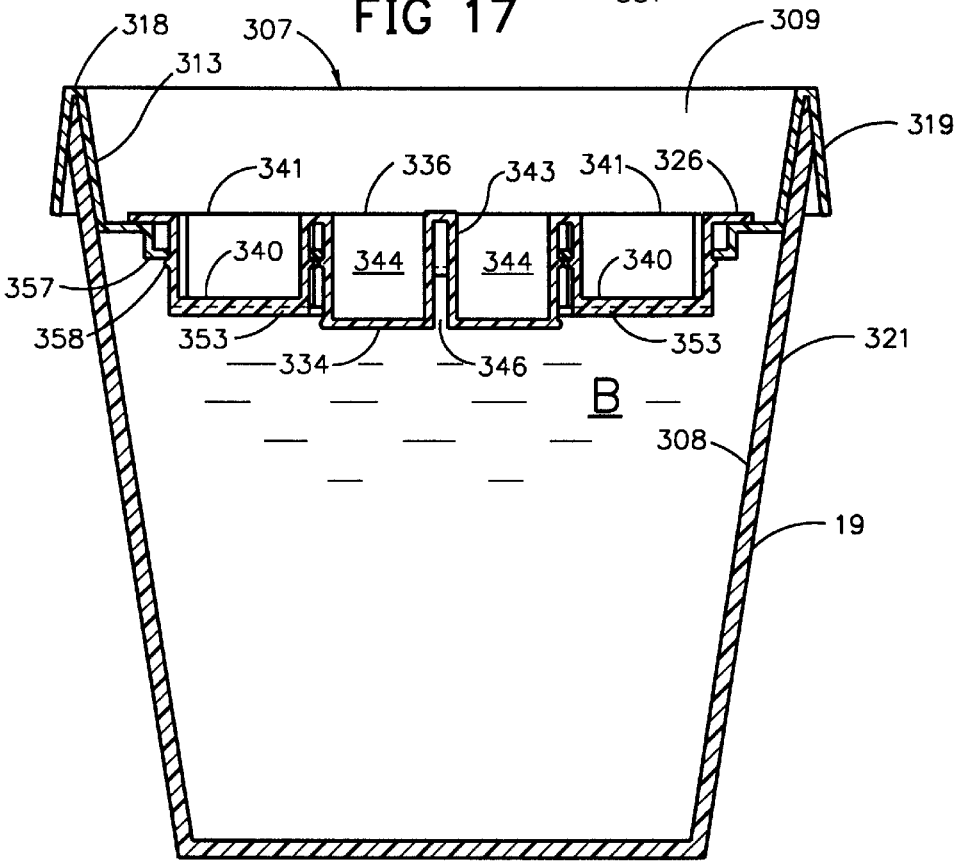
FIG. 18 is a side sectional view of the upper and lower lids and the plastic drinking cup taken along line 18—18 of FIG. 17.
Figure 19:
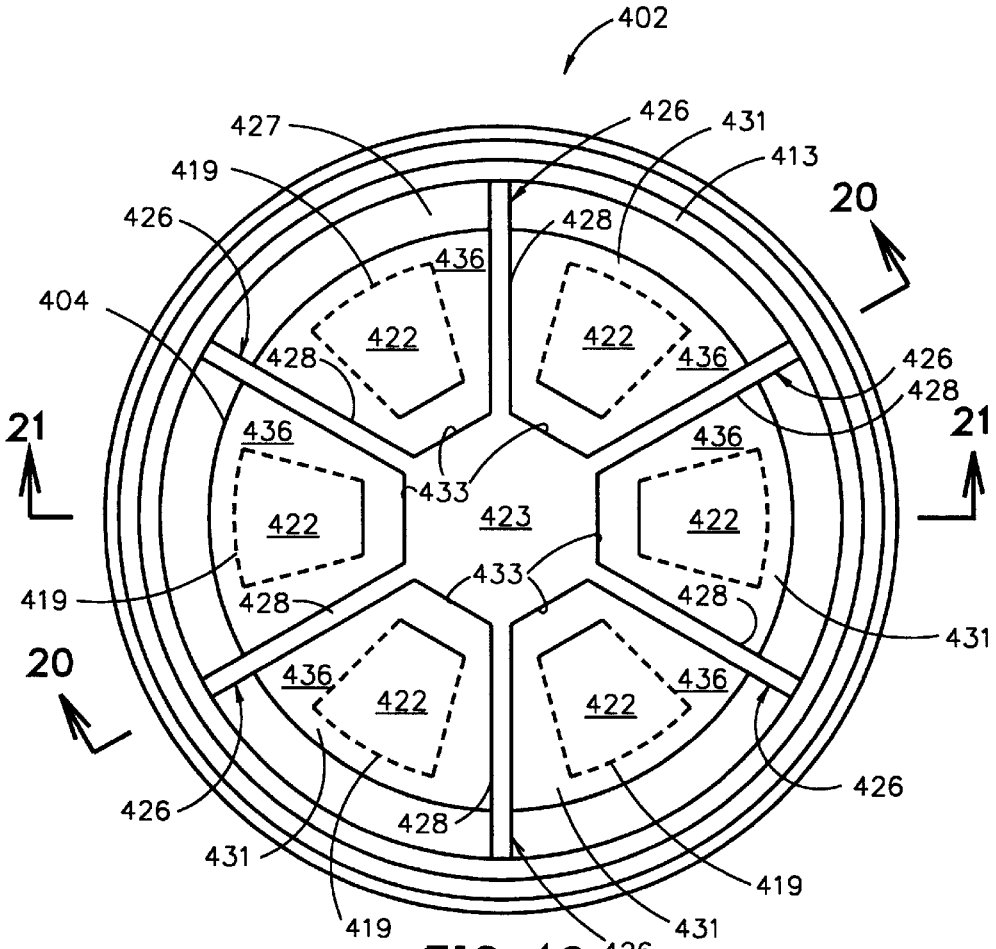
FIG. 19 is a top plan view of a lower lid of a fourth alternative embodiment of a representative guard embodying the features of the present invention.
Figure 20:
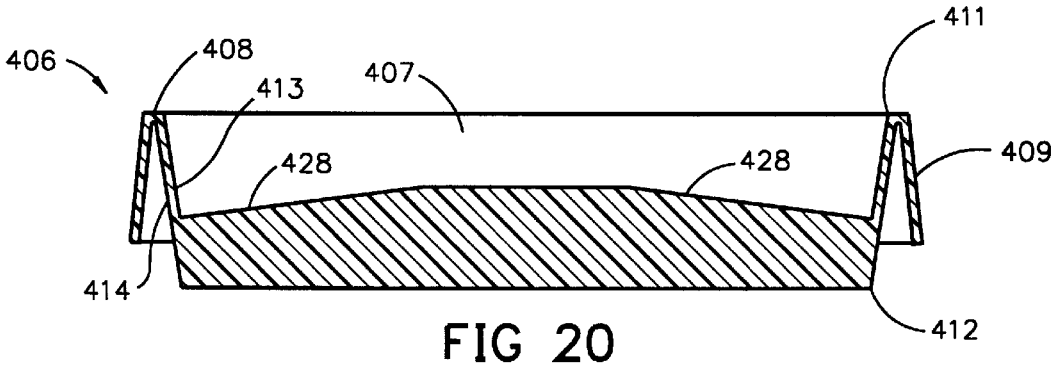
FIG. 20 is a side sectional view of the lower lid taken along line 20—20 of FIG. 19.
Figure 21:
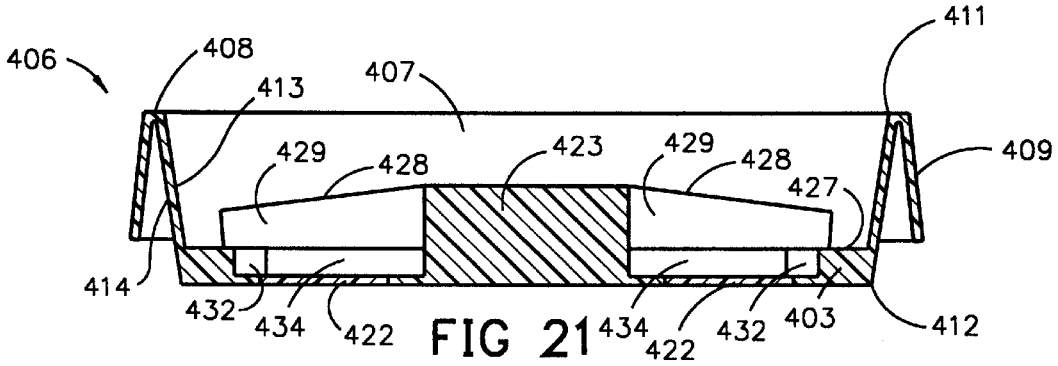
FIG. 21 is a side sectional view of the lower lid taken along line 21—21 of FIG. 20.
Figure 22:
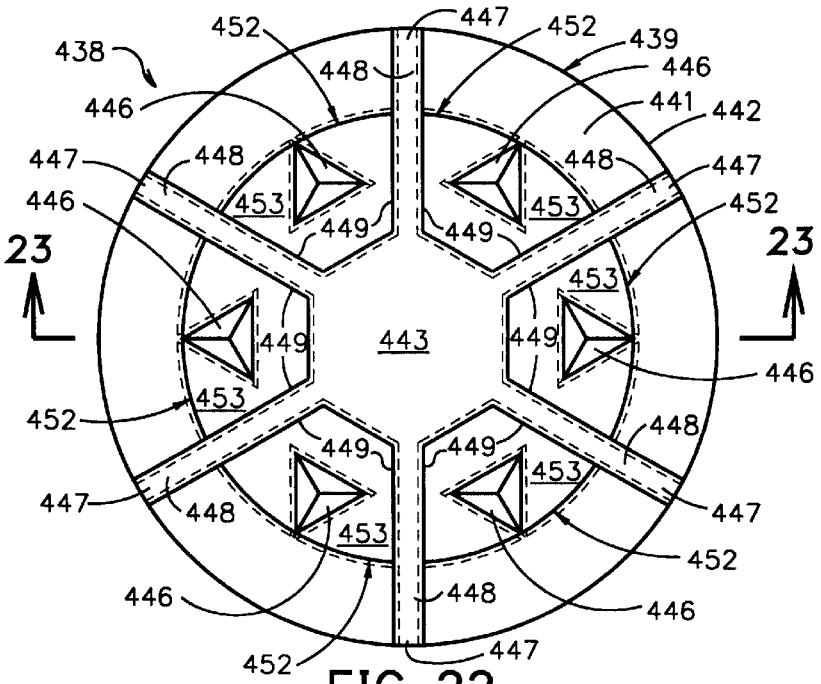
FIG. 22 is a top plan view of an upper lid of the fourth alternative embodiment of the guard embodying the features of the present invention.
Figure 23:
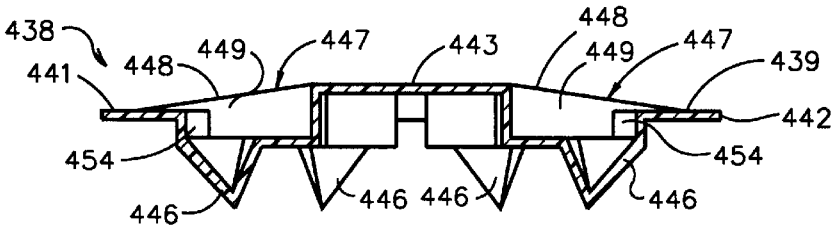
FIG. 23 is a side sectional view of the upper lid taken along line 23—23 of FIG. 22.
Figure 24:
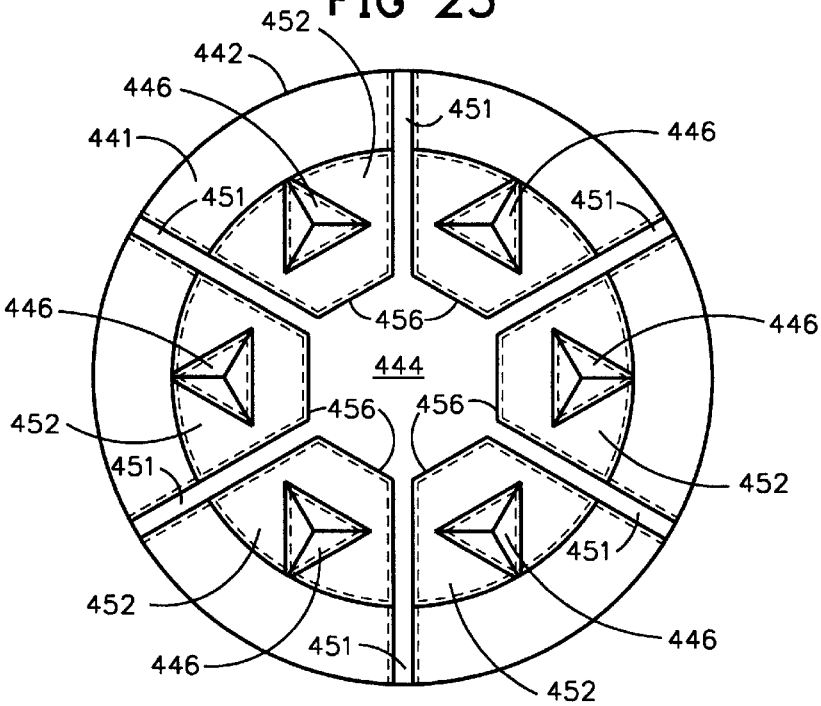
FIG. 24 is a bottom plan view of the upper lid of the fourth alternative embodiment of the guard embodying the features of the present invention.
Figure 25:
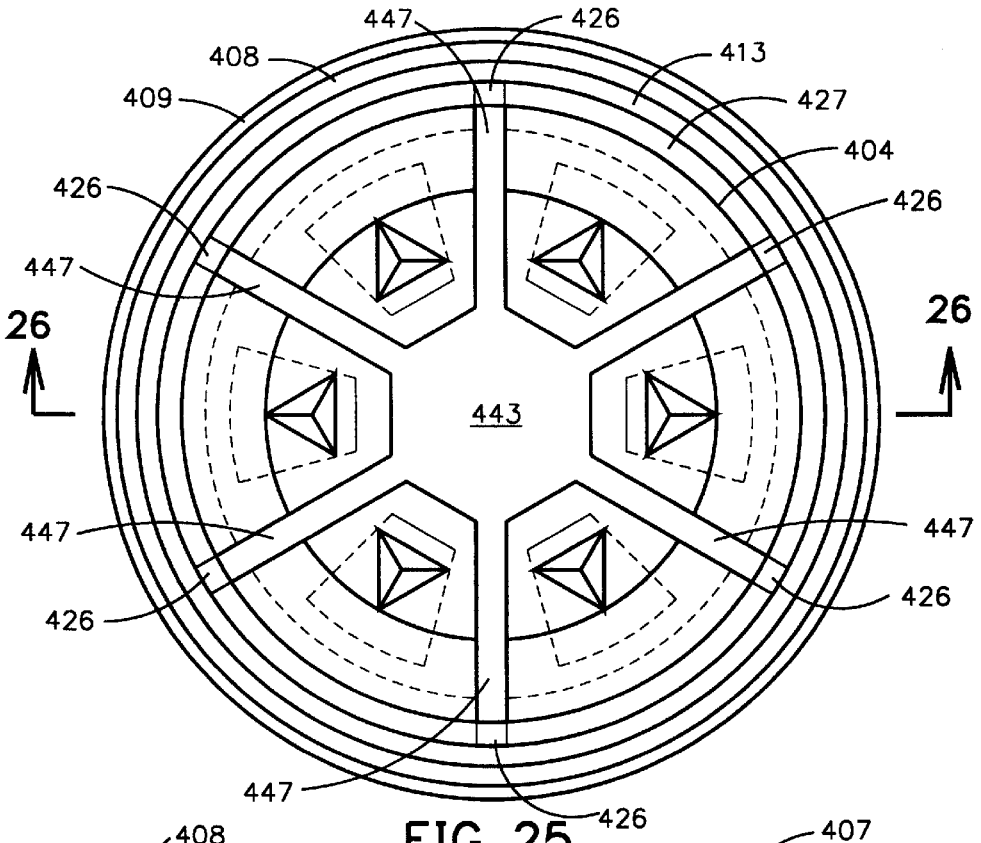
FIG. 25 is a top plan view of the upper and lower lids of the fourth alternative embodiment of the guard shown attached to a plastic drinking cup and in an open position embodying the features of the present invention.

As shown in FIGS. 12–14, upper lid 303 includes a generally circular disk 326 having a continuous outer rim 327 which, in a preferred embodiment, is slightly smaller in diameter then the diameter of outer rim 306 of disk 304. Upper lid 303 is attachable to lower lid 302, as discussed below in greater detail, and is selectively movable between an open position, shown in FIGS. 15–16, and a closed position, shown in FIGS. 17–18. Upper lid 303 further includes a means 328 for substantially preventing beverage B from passing from beneath disk 304 through central opening 324 and openings 323 to the position above disk 304 when upper lid 303 is in the closed position thereby making cup 19 substantially spillproof. Preventing means 328 is comprised of a generally hollow member 331 extending downwardly from the center of disk 326 and a plurality of generally hollow downwardly extending members 332 evenly spaced around hollow member 331. Hollow member 331 includes a generally cylindrical sidewall 333 for engaging central opening 324, a bottom 334 and an upper opening 336 extending upwardly through disk 326. Each of the members 332 include inner 337 and outer 338 generally arcuate walls interconnected by a pair of radially extending sidewalls 339 and a bottom wall 340, and an upper opening 341 extending upwardly through disk 326 for providing a means for easily grasping the upper lid 303.

When upper lid 303 is in the closed position, outer rim 327 of disk 326 engages annular shoulder 316 of disk 304. Moreover, hollow member 331 and downwardly extending members 332 extend partially through and into sealing engagement with central opening 324 and openings 323, respectively. In a preferred embodiment, the plurality of openings 323 in disk 304 have substantially the same cross-sectional shape as the plurality of downwardly extending members 332.

Preventing means 328 includes a baffle means 329 for baffling beverage B when upper lid 303 is in the open position thereby making cup 19 substantially splashproof when cup 19 is in motion. Baffle means 329 is comprised of the pairs of radially extending sidewalls 339 of members 332 which function in substantially the same manner as baffles 35 heretofore described for guard 11. When upper lid 303 is in the open position, hollow member 331 extends partially through and into frictional engagement with central opening 324, as discussed below in greater detail. The bottom walls 340 of members 332 engage an upper surface 352 of disk 304 between the plurality of openings 323 and are rotationally aligned such that sidewalls 339 baffle beverage B in the same manner as heretofore described for guard 11. Likewise, disk 326 is held in spaced apart relationship above disk 304 preferably on the same axis by baffle means 329 (i.e., sidewalls 339). Moreover, in a preferred embodiment, the diameter of outer rim 327 is slightly smaller than the diameter of inner surface 313 of the upwardly extending sidewall 309 defining an annular passage 330 which allows beverage B to flow between outer rim 327 and inner surface 313 at any point around outer rim 327 regardless of the orientation of cup 19.

Initially attaching upper lid 303 to lower lid 302 requires that hollow member 331 be aligned with and inserted into central opening 324 such that cylindrical sidewall 333 engages opening 324. Once inserted into central opening 324, hollow member 331 will partially extend through central opening 324 is when upper lid 303 is in either the open or closed positions. The only instance when hollow member 331 is not partially extending through central opening 324 is when upper lid 303 is detached from lower lid 302.

In a preferred embodiment, hollow member 331 further includes a vertically disposed cross-member 343 positioned substantially therein for at least providing the user an additional means for easily grasping and manipulating upper lid 303. Cross-member 343 preferably extends diametrically across hollow member 331 defining a pair of open-ended semi-circular compartments 344. A downwardly opening slot 346 may be included in cross-member 343 which extends through bottom 334 of member 331 for allowing the semi-circular compartments 344 to be selectively moved inwardly toward one another by squeezing or compressing cross-member 343. Compressing cross-member 343 allows hollow member 331 to be easily inserted into central opening 324. If upper lid 303 has already been attached to lower lid 302, compressing cross-member 343 disengages cylindrical sidewall 333 from central opening 324 enabling upper lid 303 to be selectively moved between the open and closed positions or detached from lower lid 302. Once the user releases (i.e., stops compressing) cross-member 343, semi-circular compartments 344 move outwardly away from one another to their original relative positions causing cylindrical sidewall 333 to engage central opening 324. In a preferred embodiment, slot 346 extends lengthwise completely through a lower portion 347 of cross-member 343 and a lower portion 348 of cylindrical sidewall 333. Lower portion 348 extends through central opening 324 when upper lid 303 is in the closed position thereby allowing the upper portion of sidewall 333 to sealably engage opening 324. When upper lid 303 is in the open position, a small amount of beverage B may pass through opening 324 via slot 346 whereupon it is baffled by baffle means 329 as described above. Therefore, hollow member 331 frictionally engages central opening 324 when upper lid 303 is in the open position and sealably engages central opening 324 when upper lid 303 is in the closed position.

Assuming that upper lid 303 is already attached to lower lid 302, moving upper lid 303 into the closed position first requires that disk 326 be rotationally oriented relative to disk 304 such that the plurality of downwardly extending members 332 are aligned vertically with the plurality of openings 323. Once oriented, disk 326 is selectively urged downwardly toward disk 304 so that members 332 extend partially through and into sealing engagement with openings 323.

If upper lid 303 is in the closed position, moving upper lid 303 to the open position first requires that hollow member 331 be disengaged from central opening 324 as described above. Upper lid 303 is then selectively pulled apart from lower lid 302 partially extracting hollow member 331 from central opening 324 a distance sufficient to completely disengage the plurality of downwardly extending members 332 from the plurality of openings 323. Next, upper lid 303 is selectively rotated on the lower lid 302 into the open position as described above. It should be noted that upper lid 303 may be initially attached in the open position to lower lid 302.

Guard 301 further includes a means 349 for rotationally aligning upper lid 303 in the open position. Means 349 is comprised a plurality of radially extending grooves 351 evenly spaced around central opening 323 on the upper surface 352 of disk 304 between the plurality of openings 323 and a plurality of radially extending raised portion 353 individually positioned on a lower surface 354 of the bottom walls 338 of members 332. In a preferred embodiment, grooves 351 extend from the central opening 323 to annular shoulder 316, and the raised portions 353 extend from the inner arcuate wall 337 to the outer arcuate wall 338 of members 332. Initially, hollow member 331 is disengaged from central opening 324 and partially extracted a distance sufficient to completely disengage the plurality of downwardly extending members 332 from the plurality of openings 323. Once extracted, upper lid 303 is selectively rotated on the lower lid 302 such that the plurality of radially extending raised portions 353 operatively engage the plurality of radially extending grooves 351. This operative engagement rotationally aligns the upper lid 303 in the open position thereby allowing the beverage B to pass from beneath disk 304 through central opening 324 and openings 323 to the position above disk 304. Once beverage B is in the position above disk 304, it is baffled by the pairs of radially extending sidewalls 339 as described for guard 11.

As illustrated in FIGS. 13 and 14, upper lid 303 may further include separate means 355 for locking the upper lid 303 in the open and closed positions. Means 355 for locking the upper lid 303 in the open position comprises an annular flange 356 extending around the cylindrical sidewall 333 of hollow member 331 adjacent bottom 334. Flange 356 engages a lower surface 357 of disk 304 when upper lid 303 is in the open position thus axially resists the extraction of hollow member 331 from central opening 324. The means 355 for locking the upper lid 303 in the closed position comprises a plurality of annular flanges 358 extending around a mid portion of cylindrical sidewall 333 and a mid portion of each of the plurality of downwardly extending members 332, respectively. Flanges 358 each engage the lower surface 357 of disk 304 when upper lid 303 is in the closed position thus axially resist the extraction of hollow member 331 and members 332 from the central opening 324 and openings 323, respectively.

A fourth alternative embodiment of the present invention is illustrated in FIGS. 19–27 as having a modified guard 401. Guard 401 includes a lower lid 402 that is attachable to cup 19 by any suitable means such as by friction or snapping or screwing onto cup 19. Lower lid 402 has a generally circular disk 403 with a continuous outer rim 404 and a sealing means 406 for sealably engaging the rim of cup 19 to prevent beverage B from flowing between means 406 and the rim when said cup 19 is moved or when drinking therefrom.

Sealing means 406 is comprised of an upwardly extending sidewall 407, an annular ledge 408 and a depending portion 409. Sidewall 407 has upper 411 and lower 412 edges and inner 413 and outer 414 surfaces wherein the lower edge 412 is integrally attached to the outer rim 404 of disk 403. In a preferred embodiment, sidewall 407 is frusto-conically shaped so that outer surface 414 sealably engages an inner surface 416 of cup 19 when lower lid 402 is attached to cup 19. Annular ledge 408 is attached to the upper edge 411 of sidewall 407 and extends outwardly therefrom for sealably engaging the rim of cup 19. Depending portion 409 is attached to annular ledge 408 and extends downwardly therefrom around the rim of cup 19 for sealably engaging an upper portion of the outer surface 417 of cup 19. It should be noted, however, that sidewall 407 may be cylindrical in shape and extend above the rim of cup 19. In this case, annular ledge 408 would be attached to the lower edge 412 of sidewall 407.

Disk 403 further includes a central portion 423 extending upwardly from the center of disk 403 and a fluid passageway means 418 for allowing beverage B to flow from beneath disk 403 to a position above disk 403. Passageway means 418 is comprised of a plurality of openings 419 extending through disk 403 which may be any shape including circular, rectangular, triangular, or pie-shaped. Openings 419 are preferably spaced in a uniform even manner around the center of disk 403 are sixty-degree intervals, however, the number, shape and spacing may vary in accordance with cost and construction complexity.

Passageway means 418 includes a fluid regulating means 421, which is selectively movable between open and closed positions, for regulating the flow of beverage B from beneath disk 403 through openings 419 to the position above disk 403. Means 421 comprises a plurality of flexible doors 422 pivotally attached to disk 403 for movement between open and closed positions. Doors 422 engage openings 419 when in the closed position to substantially prevent beverage B from flowing therethrough thus making cup 19 substantially spillproof. The doors 422 pivot downwardly away from disk 403 when in the open position for allowing beverage B to flow from beneath disk 403 through openings 419 to the position above disk 403.

A baffle means 424 is attached to lower lid 402 for baffling beverage B in the same manner as heretofore described for guard 11 when the plurality of flexible doors 422 are in the open position thereby allowing cup 19 to be substantially splashproof when cup 19 is in motion. Baffle means 424 is comprised of a plurality of radially extending ribs 426 attached to an upper surface 427 of disk 403. Ribs 426 are evenly spaced around central portion 423 between the plurality of openings 419 and extend from central portion 423 to the inner surface 413 of upwardly extending sidewall 407. Each rib 426 has an upper surface 428 and a pair of radially extending side surfaces 429. Upper surface 428 tapers downwardly from central portion 423 to the inner surface 413 of sidewall 407.

The upper surface 427 of disk 403 further includes a plurality of upwardly opening depressions 431 evenly spaced around the center of disk 403 between the plurality of radially extending ribs 426. Each depression 431 has an outer generally arcuate wall 432 and an inner wall 433 interconnected by a pair of radially extending walls 434 and a bottom wall 436 wherein the plurality of openings 419 extend through the bottom wall 436. The inner walls 433 define the outer surface 437 of central portion 423. In a preferred embodiment, the central portion 423 has a generally hexagonal outer surface 437.

Guard 401 further includes a means 438, attachable to lower lid 402, for selectively moving the plurality of flexible doors 422 between the open and closed positions. Means 438 is comprised of an upper lid 439 having generally circular disk 441 with a continuous outer rim 422 that is slightly smaller in diameter than outer rim 404 of disk 403 for allowing beverage B to flow between outer rim 442 and the inner surface 413 of sidewall 407 at any point around outer rim 404 of disk 403 when the plurality of flexible doors 422 are in the open position.

Figure 26:
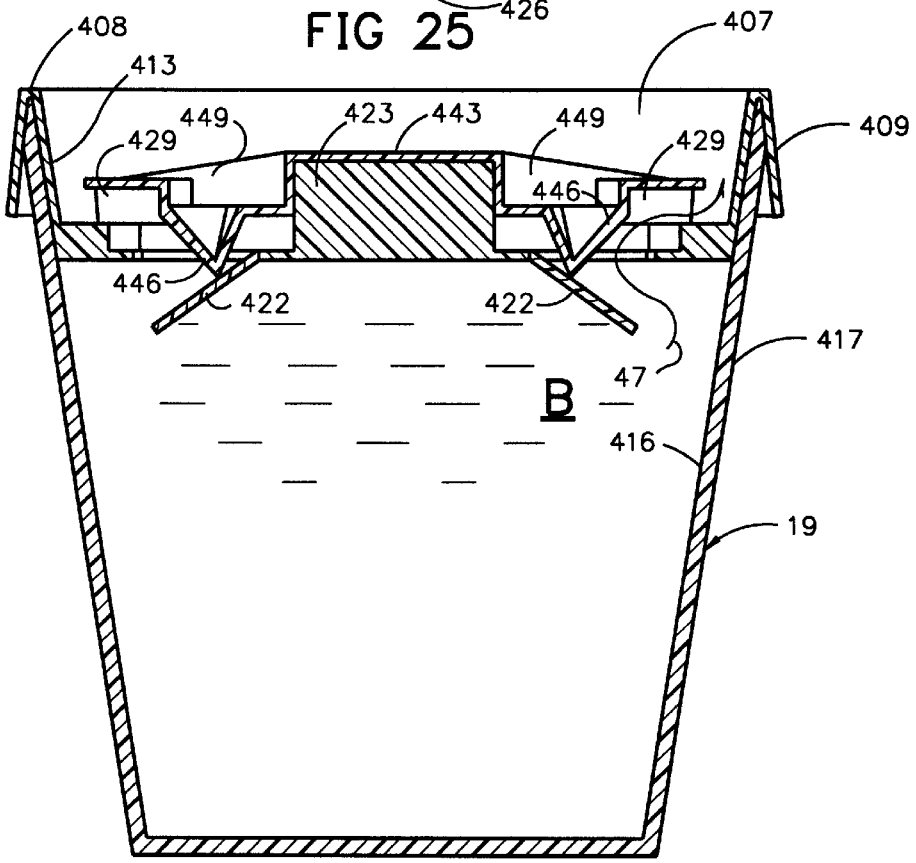
FIG. 26 is a side sectional view of the upper and lower lids and the plastic drinking cup taken along line 26—26 of FIG. 25.
Figure 27:
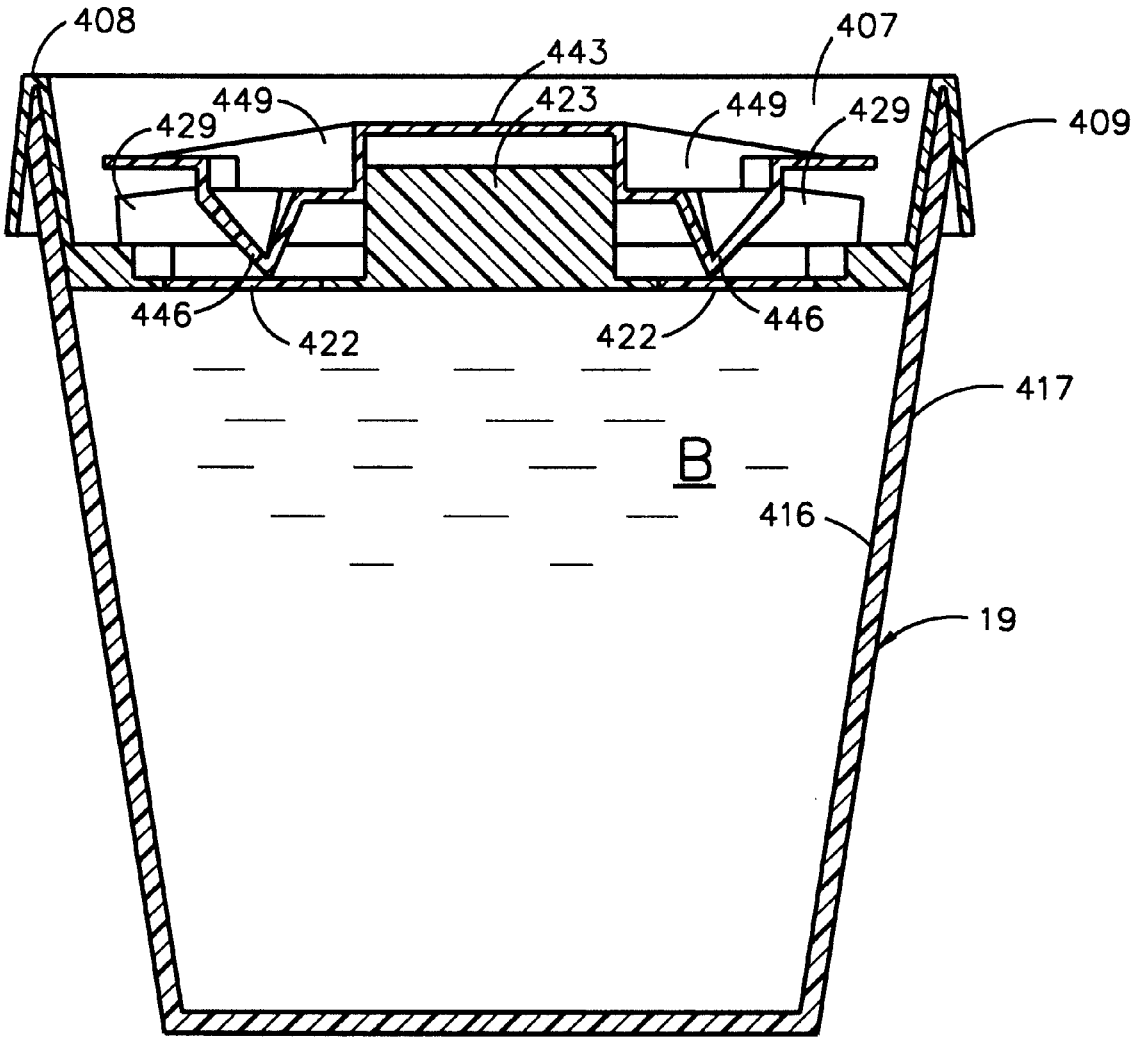
FIG. 27 is a side sectional view of the upper and lower lids and the plastic drinking cup taken along line 27—27 of FIG. 25 but shown in a closed position.

Disk 441 includes a center portion 443 extending upwardly from the center of disk 441. Center portion 443 has a downwardly opening socket 444 for frictionally engaging the central portion 423 of disk 403. The frictional engagement of center portion 443 and central portion 423 allows disk 441 to be selectively movable between first and second axial positions on disk 403 as shown in FIGS. 27 and 26, respectively. Disk 441 further includes a plurality of downwardly extending members 446 evenly spaced around center portion 443 which may be any shape including cylindrical, rectangular, square or pyramid shaped. When disk 441 is in the first axial position, members 446 are positioned above and do not engage the plurality of flexible doors 422. When disk 441 is in the second axial position, members 446 operatively engage the plurality of flexible doors 422 pivotally moving the doors 422 to their open positions thus allowing beverage B to flow from beneath disk 403 through openings 419 to the position above disk 403 whereupon beverage B is baffled by the plurality of radially extending ribs 426 as heretofore described for guard 11. It should be noted that disk 441 is disposed above and spaced apart from disk 403 when the flexible doors 422 are in their open and closed positions and when disk 403 is in the first and second axial positions.

Disk 441 further includes a plurality of hollow downwardly opening radially extending ribs 447. Each rib 447 has an upper wall 448 and a pair of substantially vertical sidewalls 449 extending downwardly from upper wall 448 partially through disk 441 defining a radial channel 451. Upper wall 448 tapers downwardly from center portion 443 to outer rim 442 of disk 441 and engages the upper surface 428 of ribs 426 when disk 441 is in the second axial position, as shown in FIG. 26. Moreover, each pair of vertical sidewalls 449 frictionally engage an upper portion of the pairs of radially extending side surfaces 429 of ribs 426 when disk 441 is in the second axial position.

Disk 441 further includes a plurality of downwardly extending portions 452 evenly spaced around the center of disk 441 between the plurality of hollow ribs 447. Portions 452 are generally hollow and include openings 453 extending upwardly through disk 441 for providing a means for easily grasping upper lid 439. Each portion 452 is comprised of an outer generally arcuate wall 454 and an inner wall 456 interconnected by the pairs of vertical sidewalls 449 of ribs 447 and a bottom wall 457. The plurality of downwardly extending members 446 extend downwardly from portions 452. Inner walls 456 define an inner surface shape of socket 444 which, in a preferred embodiment, is generally hexagonal in shape to match central portion 423.

While a description of the present invention has been provided in detail, such description is for illustrative purposes only, it is to be understood that changes and variations may be made without departing from the spirit or scope of the following appended claims. For instance, guards 301 and 401 may be modified slightly by hollowing out certain portions so that a plurality of guards of guards may be stacked upon one another.

What is claimed is:

1. A guard for preventing spilling or splashing of a liquid from a container having a sidewall with inner and outer surfaces and a rim, said guard comprising:

(a) a lower lid attachable to said container, said lower lid having a disk with a continuous outer rim and sealing means for sealably engaging said rim of said container to prevent said liquid from flowing over said rim of said container when said container is moved;

(b) said lower lid disk including fluid passageway means for allowing said liquid to flow from beneath said lower lid disk to a position above said lower lid disk;

(c) said fluid passageway means including fluid regulating means, selectively movable between open and closed positions, for regulating said flow of said liquid from beneath said lower lid disk through said fluid passageway means to said position above said lower lid disk, said container being substantially spillproof when said fluid regulating means is in said closed position and;

(d) an upper lid, attachable to said lower lid and selectively movable axially between first and second axial positions, said fluid regulating means being in said closed position when said upper lid is in said first axial position, said fluid regulating means and said upper lid being engaged with one another when said upper lid is in said second axial position whereby said fluid regulating means is moved to said open position; and (e) baffle means, attached to said lower lid, for baffling said liquid when said fluid regulating means is in said open position thereby allowing said container to be substantially splashproof when said container is in motion; wherein:

(f) said fluid passageway means comprises a plurality of openings extending through said lower lid disk, said openings being spaced around the center of said lower lid disk;

(g) said fluid regulating means comprises a plurality of flexible doors pivotally attached to said lower lid disk for movement between said open and closed positions, said doors engaging said plurality of openings when in said closed position to substantially prevent the liquid from flowing therethrough, said doors pivoting downwardly away from said lower lid disk when in said open position for allowing the liquid to flow from beneath said lower lid disk through said plurality of openings to said position above said lower lid disk.

2. A guard as claimed in claim 1, wherein said lower lid disk includes a central portion extending upwardly from the center of said lower lid disk.

3. A guard for preventing spilling or splashing of a beverage from a drinking container having a sidewall with inner and outer surfaces and a rim, said guard comprising:

(a) a lower lid attachable to said drinking container, said lower lid having a disk with a continuous outer rim and sealing means for sealably engaging said rim of said drinking container to prevent said beverage from flowing over said rim of said drinking container when said drinking container is moved or when drinking therefrom;

(b) said lower lid disk including fluid passageway means for allowing said beverage to flow from beneath said lower lid disk to a position above said lower lid disk;

(c) said fluid passageway means including fluid regulating means, selectively movable between open and closed positions, for regulating said flow of said beverage from beneath said lower lid disk through said fluid passageway means to said position above said lower lid disk, said drinking container being substantially spillproof when said fluid regulating means is in said closed position;

(d) an upper lid, attachable to said lower lid and selectively movable axially between first and second axial positions on said lower disk, said fluid regulating means being in said closed position when said upper lid is in said first axial position, said fluid regulating means and said upper lid being engaged with one another when said upper lid is in said second axial position whereby said fluid regulating means is moved to said open position; and (e) baffle means, attached to said lower lid, for baffling said beverage when said fluid regulating means is in said open position thereby allowing said drinking container to be substantially splashproof when said drinking container is in motion; wherein (f) said fluid passageway means comprises a plurality of openings extending through said lower lid disk, said openings being spaced around the center of said lower lid disk;

(g) said fluid regulating means comprises a plurality of flexible doors pivotally attached to said lower lid disk for movement between said open and closed positions, said doors engaging said plurality of openings when in said closed position to substantially prevent said beverage from flowing therethrough, said doors pivoting downwardly away from said lower lid disk when in said open position for allowing said beverage to flow from beneath said lower lid disk through said plurality of openings to said position above said lower lid disk;

(h) said lower lid disk includes a central portion extending upwardly from the center of said lower lid disk;

(i) said baffle means comprises a plurality of radially extending ribs attached to an upper surface of said lower lid disk, said ribs spaced around said central portion between said plurality of openings, each said rib having an upper surface and a pair of radially extending side surfaces.

4. A guard as defined in claim 3, wherein said upper surface of said plurality of the tapers downwardly from said central portion to said inner surface of said upwardly extending sidewall.

5. A guard as defined in claim 4, wherein said means for selectively moving said fluid regulating means between said open and closed positions comprises:

(a) an upper lid having a disk with a continuous outer rim;

(b) said upper lid disk including a center portion extending upwardly from the center of said upper lid disk, said center portion including a downwardly opening socket for frictionally engaging said central portion of said lower lid disk; said upper lid disk being selectively movable between said first and second axial positions on said lower lid disk;

(c) said upper lid disk further including a plurality of downwardly extending members spaced around the center of said upper lid disk, said members positioned above said plurality of flexible doors when said upper lid disk in said first position, said members operatively engaging said plurality of flexible doors when said upper lid disk is in said second position, said operative engagement pivotally moving said doors to said open position thereby allowing said beverage to flow from beneath said lower lid disk through said plurality of opening to said position above said lower lid disk.

6. A guard as defined in claim 5, wherein said upper lid disk further includes a plurality of hollow downwardly opening radially extending ribs, each of said hollow ribs having an upper wall and a pair of substantially vertical sidewalls extending downwardly from said upper wall partially through said upper lid disk defining a radial channel, said upper wall of said hollow ribs tapering downwardly from said center portion to said continuous outer rim of said upper lid disk and engaging said upper surface of said plurality of radially extending ribs on said lower lid disk when said upper lid disk is in said second position, said pair of vertical sidewalls frictionally engaging an upper portion of said pair of radially extending side surfaces of said plurality of radially extending ribs on said lower lid disk when said upper lid disk is in said second position.

7. A guard as defined in claim 6, wherein said upper lid disk is disposed above and spaced apart from said lower lid disk when said plurally of flexible doors are in said open and closed positions.

8. A guard as defined in claim 7, wherein said upper lid disk is disposed above and spaced apart from said lower lid disk when said upper lid disk is in said first and second positions.

9. A guard as defined in claim 8, wherein the diameter of said upper lid disk is smaller than the diameter of said lower lid disk for allowing said beverage to flow between said outer rim of said upper lid disk and said inner surface of said upwardly extending sidewall at any point around said outer rim of said upper lid disk when said plurality of flexible doors are in said open position.

10. A guard as defined in claim 9, wherein said upper surface of said lower lid disk further includes a plurality of upwardly opening depressions spaced around the center of said lower lid disk between said plurality of radially extending ribs, said depression having an outer generally arcuate wall and an inner wall interconnected by a pair of radially extending walls and a bottom wall, said plurality of openings extending through said bottom wall.

11. A guard as defined in claim 10, wherein said inner walls of said plurality of depressions define an outer surface of said central portion of said lower lid disk.

12. A guard as defined in claim 11, wherein said upper lid disk further includes a plurality of downwardly extending portions spaced around the center of said upper lid disk between said plurality of hollow ribs.

13. A guard as defined in claim 12, wherein said plurality of downwardly extending portions are generally hollow and include openings extending upwardly through said upper lid disk for providing a means for easily grasping said upper lid.

14. A guard as defined in claim 13, wherein said plurality of downwardly extending portions each comprise an outer generally arcuate wall and an inner wall interconnected by said pairs of substantially vertical sidewalls of said plurality of hollow ribs and a bottom wall, said plurality of downwardly extending members extending downwardly from said portions.

15. A guard as defined in claim 14, wherein said inner walls of said plurality of downwardly extending portions define an inner surface of said downwardly opening socket of said center portion.

16. A guard as defined in claim 15, wherein said outer surface of said upwardly extending sidewall of said lower lid sealably engages said inner surface of said drinking container when said lower lid is attached to said drinking container.

17. A guard for preventing spilling or splashing of a liquid from a container, said guard comprising:

(a) a lower lid attachable to the container, said lower lid having a disk and a sidewall integral therewith and extending upwardly therefrom; and (b) an upper lid having a disk with a continuous outer rim attachable to said lower lid and selectively movable axially between a first axial position and a second axial position, wherein the container is substantially spillproof while said upper lid is in said first axial position and is substantially splashproof when said upper lid is in said second axial position, said outer rim of said upper lid disk being spaced apart from said sidewall of said lower lid whereby the liquid may flow between said outer rim and said sidewall when said upper lid is in said second axial position; wherein:

(c) said lower lid sealably engages a rim of the container;

(d) said lower lid disk includes a plurality of openings extending therethrough;

(e) said lower lid further comprises a plurality of flexible doors pivotally attached to said lower lid disk for movement between said closed and open positions, said doors being in said closed position when said upper lid in said first axial position, said doors engaging said openings when in said closed position to substantially prevent the liquid from flowing therethrough, said upper lid engaging said doors when said upper lid is in said second axial position thereby moving said doors to said open position, said doors being pivoted downwardly away from said lower disk when in said open position for allowing the liquid to flow from beneath said lower disk through said openings to a position above said lower lid disk and then between said outer rim of said upper lid disk and said sidewall of said lower lid.

18. A guard as defined in claim 18, wherein:

said lower lid disk further includes an upper surface and said lower lid further includes a plurality of radially extending ribs attached to said upper surface and disposed between said openings, said ribs being effective for baffling the liquid when said doors are in said open position thereby allowing the container to be substantially splashproof when the container is in motion.

19. A guard as defined in claim 17, wherein:

said upper lid further includes a plurality of members extending downwardly from said upper lid disk, each of said members engaging one or said doors when said upper lid is in said second axial position.

20. A guard as defined in claim 17, wherein:

said lower lid disk includes a plurality of openings extending therethrough and an upper surface;

said lower lid further includes a plurality of radially extending ribs attached to said upper surface and disposed between said openings, said ribs being effective for baffling the liquid when said doors are in said open position thereby allowing the container to be substantially splashproof when the container is in motion.

21. A guard as defined in claim 20, wherein:

said openings are spaced apart from a sidewall of the container.

* * * * *